US005284034A

United States Patent [19]

Weis et al.

[11] Patent Number: 5,284,034

[45] Date of Patent: Feb. 8, 1994

[54] PATTERNED FABRIC AND MACHINE AND METHOD FOR MAKING THE FABRIC

[75] Inventors: Joachim Weis, Obertshausen; Gerhard Bergmann, Heusenstamm, both of Fed. Rep. of Germany

[73] Assignee: Karl Mayer Textilmaschinenfabrik GmbH, Obertshausen, Fed. Rep. of Germany

[21] Appl. No.: 978,269

[22] Filed: Nov. 18, 1992

[30] Foreign Application Priority Data

Nov. 21, 1991 [DE] Fed. Rep. of Germany ..... 4138255

[51] Int. Cl.[5] ..... D04B 21/14

[52] U.S. Cl. ..... 66/195; 66/204

[58] Field of Search ..... 66/192, 195, 196, 204, 66/207, 214

[56] References Cited

U.S. PATENT DOCUMENTS 3,340,134 9/1967 Porter et al. ..... 66/195
5,150,587 9/1992 Bergmann ..... 66/195
5,172,570 12/1992 Wade et al. ..... 66/192 X

FOREIGN PATENT DOCUMENTS 1182283 6/1959 France ..... 66/195

*Primary Examiner*—Clifford D. Crowder
*Assistant Examiner*—John J. Calvert
*Attorney, Agent, or Firm*—Omri M. Behr; Matthew J. McDonald

[57] ABSTRACT

A warp knitted fabric has threads of a ground thread system forming a fabric ground. A pattern thread system also forms different patterned areas both in the weft direction as well as in the warp direction. In a basis area there is provided either cloth lapping (1-0/2-3-1 or 0-1/3-2-1). In the patterned area, a sequence is built by different lappings selected from a group consisting of pillar, tricot, cloth, satin and velvet stitches, in which the average length of the underlaps in predetermined pattern repeats is substantially similar to the underlap length of the cloth lapping. This gives rise to numerous new patterning possibilities, in particular for a Jersey fabric. In addition to a described process, a warp knitting machine is provided for making such warp knitted goods. The machine comprises, in addition to a guide bar for the formation of the ground fabric, two pattern forming jacquard controlled guide bars whose guide to guide spacing is twice as large as the space between the needles of the needle bed. Bar control arrangements for the displacement of the bars and jacquard command arrangements for the displacement with respect to individual needles, allow selection of either cloth lap or any of the previously mentioned sequences of different laps. A common warp beam may be used for both partial systems of the pattern thread system.

14 Claims, 5 Drawing Sheets

Fig.1
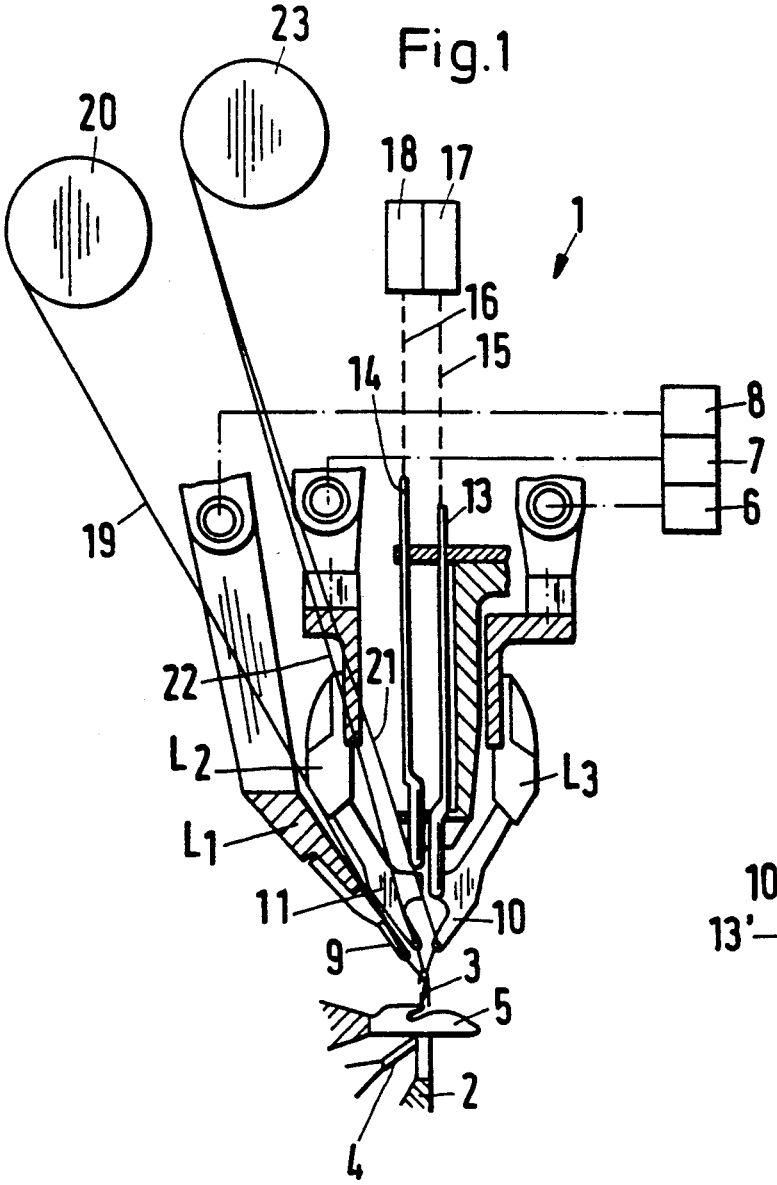
Fig.3
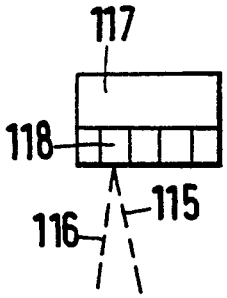
Fig.2
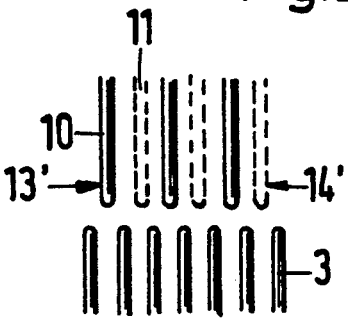
Fig.4
| | | | |
|---|---|---|---|
| B | M1 | M3 | |
| M2 | B | M2 | |
| M3 | M1 | B | |
| | | | |

PATTERNED FABRIC AND MACHINE AND METHOD FOR MAKING THE FABRIC

The present invention is directed to warp knitted fabric which has differently structured areas, both in the weft and warp directions, as well as warp knitting machines and methods for the formation of such fabric.

DE-OS 40 01 621 discloses warp knitted fabric which has a fabric ground in tricot lap and a patterning of pile threads. For this purpose, the warp knitting machine utilized for the production of such fabric, is provided with at least one, suitably two jacquard guide bars which, in cooperation with a pile sinker bar displaceable in the longitudinal direction, either form the pile threads into pile loops or binds them flat into the groundware.

The brochure from the LIBA Company, entitled "ESJ-Electronic Sectional Jacquard," discloses warp knitted fabric wherein the groundware, in tricot lap is worked together with a pattern building cloth lap (the term "cloth" as utilized herein indicates a 1-02/3-1 lap, that is, 1-0/2-3-1 or 0-1/32-2-1 lap). This cloth lap is produced by two guide bars whose guide spacing is twice as great as that between the needles of the needle bar, so that the guides pass through each alternate needle gap. One guide bar is jacquard controlled by this means and thus the cloth lap is displaced by one needle space by needle displacement or is shortened to a tricot lap to produce the patterning. The first alternative results in a broken pattern which is undesired for many fabrics, while the second alternative leads to such a reduced thread utilization with respect to a cloth lap, that the fabric is subject to substantial tension differences.

German reference DE-OS 17 85 138 discloses production of warp knitted fabric with plastic patterning. In this process, there is utilized a single guide rail which works with complete thread utilization to form a ground pattern. Two guide rails are utilized for the formation of the pattern, which works with a filet input of one full - one empty, and are served by a common warp beam. This leads to substantially large underlap differences next to each other in a given stitch row, for example, a tricot lap and a satin lap, wherein these laps are so changed that each of these guide rails performs the same number of different laps within the same pattern repeat.

An object of the present invention is to provide warp knitted fabric patterned both in the weft direction and in the warp direction, whose upper surface structure is determined partially by cloth laps and partially by other laps and whose pattern forming threads do not yield undesirable tensions when they are pulled from a common warp beam. Another object is providing a warp knitting machine and a process for the formation of such warp knitted fabric.

SUMMARY OF THE INVENTION

In accordance with the illustrative embodiments demonstrating features and advantages of the present invention there is provided a warp knitted fabric having both in the weft as well as the warp direction differently structured areas. The fabric has at least one ground thread system for the formation of a fabric ground. The fabric also has a pattern thread system including at least a pair of threads which are worked in the warp direction successively in (a) a plurality of basis regions in cloth stitch, and (b) a plurality of pattern areas in a sequence of different laps, selected from the group consisting of pillar, tricot, cloth, satin, and velvet stitches, and ordered with a predetermined periodicity to make the mean length of the underlap segment substantially equal to the underlap length in a cloth lap.

In accordance with a related warp knitting machine of the same invention, this machine can produce warp knitted fabric with a needle bar having needles. The machine also has at least one ground guide bar for laying ground fabric. Also included are two pattern-forming jacquard guide bars for laying a pattern thread system. Each of these jacquard guide bars has a plurality of jacquard guides at a spacing of at least twice that of the needles. The machine also has a jacquard bar control arrangement coupled to the jacquard guide bars for moving them. Also included is a jacquard command arrangement for displacing the jacquard guides. The machine has also a common warp beam for supplying threads to the two jacquard guide bars. The jacquard bar control arrangements and jacquard command arrangement are mutually operable to selectively lay threads of the pattern thread system in (a) cloth lap or (b) in a sequence of different laps, selected from the group consisting of pillar, tricot, cloth, satin, and velvet stitches, and ordered with a predetermined periodicity to make the mean length of the underlap segment substantially equal to the underlap length in a cloth lap.

In a related method for the same invention, warp knitted fabric is prepared with a ground thread system and a pattern thread system. The process includes the step of providing a ground fabric with the ground thread system. Another step is laying, in part, cloth lapping with the pattern thread system. Still another step is laying, in part, with the pattern thread system a sequence of varying laps selected from the group consisting of pillar, tricot, cloth, satin, and velvet, and ordered with a predetermined periodicity to make the mean length of the underlap segment substantially equal to the underlap length in a cloth lap.

Advantages flow from fabricating such fabric and from employing such apparatus and methods for making the fabric. The preferred fabric is a pile ware having both in the weft as well as the warp direction, differently structured areas having at least a ground thread system for the formation of a fabric ground and a pattern thread system. The pattern thread system comprises threads which are worked in the warp direction successively in basis regions in cloth stitch and pattern areas in such a sequential succession of different laps, selected from the group consisting of pillar stitch, tricot, cloth, satin, and velvet, such that the mean segment length of the underlap in predetermined periodicity, is substantially equal to the underlap length in the cloth lap.

The preferred process produces warp knitted fabric wherein a ground thread systems forms the fabric ground. The pattern thread system is laid partially as cloth and partially in the above-identified sequence of different lappings.

By the sequential provision of different lappings selected from the group consisting of pillar stitch, tricot, cloth, satin and velvet, it is possible to obtain a plurality of upper surface structures which differ from the cloth lap and in addition thereto, by changing the sequence, offer additional possible variations.

Because the average length of the underlap in predetermined pattern repeats is chosen to be the same as a cloth lap, on the average, the same amount of thread is consumed in the thus formed areas and in the areas formed by the cloth lap, despite differences in lapping type. As far as the different thread tensions which are generated by the different lappings are concerned, these equalize themselves again within a given pattern repeat.

By providing several pattern areas with different lapping, the patterns can be formed by more than two different upper surface structures, since one may form different combinations from the designated group of laps.

In certain preferred embodiments the repeat period includes an equal number of tricot and satin laps. The periodicity can also encompass the same number of pillar stitch and velvet lappings. Also the periodicity can comprise cloth laps. All these variations make possible different patternings while still maintaining the same average underlap length.

In a further embodiment of the upper surface structure, the pattern thread system comprises two partial systems whose threads are laid differently in such a way that in the middle of the patterning area they form common stitches with all of the stitches of the ground fabric. When the pattern thread system comprises two partial systems whose threads are laid differently, there are formed mutual crossings which can be clearly differentiated from the cloth lap. As a result of the thread crossings, there is also no one-sided tensional distortion of the knitted fabric in the pattern regions.

It is particularly advantageous when the ground thread system is laid as a tricot lap. There is thus produced a Jersey fabric comprising tricot and cloth laps which is patterned on the cloth side.

The warp knitting machine itself is provided with a needle bar, at least one guide bar for laying the ground fabric, and two pattern-forming jacquard guide bars whose guide spacing is at least twice as great as the needle spacing. The machine also has the appropriate bar control arrangement for bar displacement, and a jacquard command arrangement for deflection of the guides. Also a common warp beam can supply threads running to both jacquard guide bars of one pattern thread system. The bar control arrangements with the assistance of the jacquard command arrangement, can selectively lay the threads of the pattern system in cloth lap or in successive sequence of different lappings, selected from the group consisting of pillar, tricot, cloth, satin, and velvet stitches. Thus the average length of the underlap in predetermined periodicities is substantially equal to the underlap length in the cloth lap.

By use of two pattern forming jacquard guide bars in a particularly simple manner, one is able to obtain a warp knitted fabric containing a plurality of patterns (with patterning in weft and warp direction; common warp beam for the pattern thread system; and avoidance of excessive tensions in the fabric). The use of a bar control arrangement enables the jacquard guide bars to have a repeated ground pattern in each pattern repeat, which determines the nature of the upper surface of the fabric. By deflection of selected jacquard guides, other upper surface structures may be obtained. In particular, by utilizing two jacquard bars, it is possible to provide lappings involving the crossing of threads forming said pattern, which is often preferred.

In one embodiment of the machine, the guides of one jacquard bar are deflectable in the opposite direction from the guides of the other jacquard bar. This makes it possible, under otherwise similar conditions, to obtain the greatest number of different laps with merely unidirectionally displaceable jacquard guides, which have a higher working accuracy than those guides displaceable bidirectionally. Furthermore, it is possible to provide symmetrical control of the guides.

With respect to the majority of the available lapping combinations, neighboring needles which belong to different jacquard guide bars, are controlled as pairs at the same time by a common jacquard control element.

Instead of the cloth lap, there may be utilized as the basic ground displacement a displacement that has in each pattern repeat the same number of tricot and satin laps either alone, or in combination with cloth laps. This has the advantage that by simply varying the control, further lapping patterns are obtained (other than just the cloth lapping) using one-sided displaceable guides. In this embodiment, besides a first deflection program running periodically with exclusively a cloth lap, the jacquard command arrangement runs at least one further deflection program with another sequence of laps within its repeat period, as well as running a ground displacement. Preferably this other sequence has the same number of pillar stitches and velvet laps, formed either alone or together with cloth stitches.

The improved process for producing a warp knitted fabric with a ground thread system can make a ground fabric and with a pattern thread system can partially lay cloth lapping, and partially lay a sequence of different laps selected from the group consisting of pillar, tricot, towel, satin, and velvet stitches, so that the average length of the underlap in predetermined periodicities is substantially equal to the underlap length in the cloth lap. These process steps lead to the desired warp knitted fabric.

In a further embodiment, the pattern thread system utilizes two partial jacquard control systems. The ground displacement for both partial systems within each repeat periodicity has the same number of tricot and satin laps, either alone or in combination with the cloth laps. This arrangement enables a jacquard control to achieve more than two lapping patterns in the preferred embodiments, such as: repeating cloth laps; a repeating sequence of different laps other than the ground displacement; or a repeating sequence having the same number of pillar or satin laps, either alone or in combination with cloth laps.

DESCRIPTION OF THE DRAWINGS

The present invention can be more fully understood by reference to the detailed description and accompanying drawings showing presently preferred embodiments, wherein:

FIG. 1 is a schematic representation of the operating area of a warp knitting machine according to the principles of the present invention.

FIG. 2 is a schematic view of the jacquard guides in relationship to the needles of FIG. 1.

FIG. 3 is a schematic diagram of the jacquard command arrangement.

FIG. 4 is a schematic plan view of a fabric according to the principles of the present invention.

DETAILED DESCRIPTION OF THE PREFERRED EMBODIMENT

Figure 6:
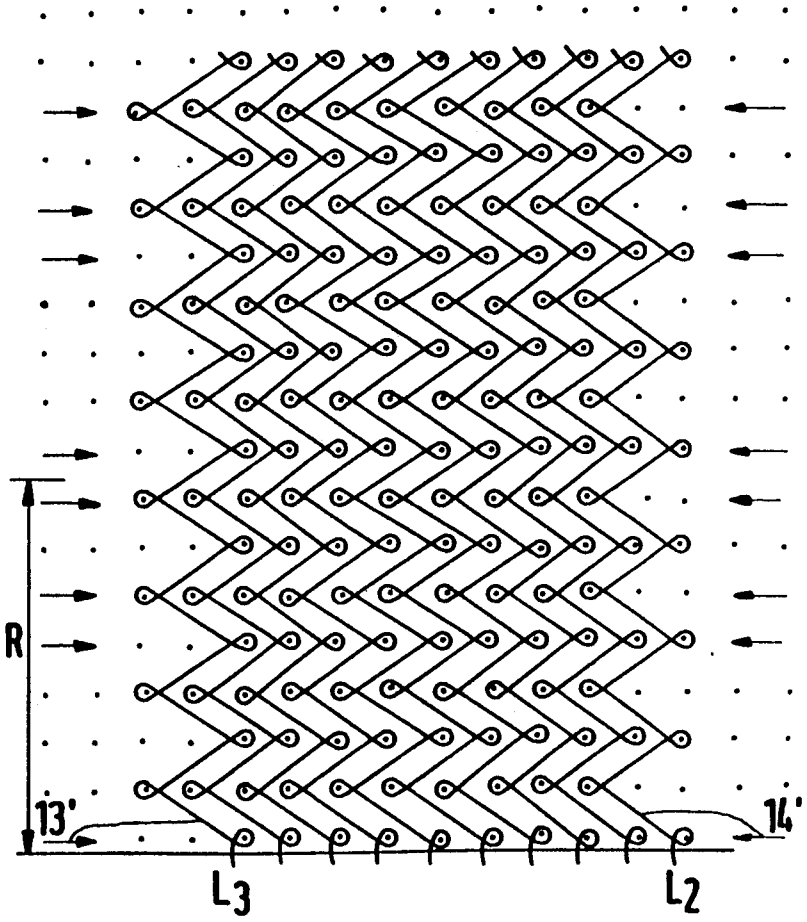
FIG. 6 is a lapping diagram derived from FIG. 5 wherein both partial systems of the pattern thread systems are following a first deflection program, which provides a cloth lap.

A warp knitting machine 1 comprises a needle bar 2 having a plurality of spaced needles 3, which operate in conjunction with sliders 4 as well as closing knock-over sinkers 5. Three guide bars are utilized: two jacquard guide bars L2 and L3 for the laying of a pattern thread system by each of two partial systems; and one guide bar L1 for laying the ground thread system. The two systems of bars L2 and L3 are partial because each individually covers only part of the full complement of needles 3.

The guide bars L3, L2 and L3 are displaced or shogged in the usual manner by guide bar control arrangements 6, 7 and 8, respectively, in their longitudinal direction in accordance with a predetermined pattern. Control arrangements for producing this longitudinal displacement may use cams, pattern chains, or the like.

A plurality of spaced guides 9 are rigidly affixed in guide bar L1. Guides 9 have the same mutual spacing as needles 3. The guide to guide spacing between the guides 10 and 11 in their respective guide bars L3 and L2 is twice the needle to needle spacing. Guide bars L1, L2 and L3 can swing to bring their guides through the needles. Guides 10 and 11 are aligned with the needle gaps (FIG. 2) and can be deflected in opposite directions by deflection sinkers 13 or 14, each by one needle space (see arrows 13' and 14' in FIG. 2). The deflection sinkers 13 and 14 are activated via harness cords 15 and 16, which in turn are activated by the corresponding jacquard arrangements 17 and 18, in accordance with a predetermined deflection program. The deflection program can be executed by a computer that is synchronized to movements in machine 1 by an input transducer (not shown) responsive to machine cycles.

In accordance with the illustration of FIG. 3, a common jacquard command arrangement 117 may be utilized which comprises a plurality of individual control elements 118, for example, electromagnets operating on two harness cords 115, 116, or the like, which lead to the deflection sinkers of the respective jacquard guide bars. For example, each pair of cords 115, 116 may connect to deflection sinkers of two adjacent jacquard guides that are from different guide bars.

The threads 19 forming the ground thread system are pulled from one warp beam 20 and led to the working area via guides 9. The threads 21 and 22 forming both partial systems of the pattern thread system are pulled from a common warp beam 23.

Using threads 19, the warp knitting machine of FIG. 1 produces a self-supporting surface or ground fabric which, in particular, is laid with tricot stitches. The threads 21 and 22 in the basis area B as shown in FIG. 4 may be laid as cloth laps. In the pattern areas M1, M2 and M3, different lapping combinations are utilized, which, however, have the same thread consumption in each pattern repeat as the cloth laps in basis area B. By using tricot stitches as the groundware pattern, there is thus produced an interestingly patterned, knitted Jersey fabric.

The lapping diagrams of FIGS. 5 through 8 further explain the structure of the fabric and its mode of production. The basis area B is produced in accordance with FIG. 6. Specifically, both of the pattern thread systems are laid with cloth stitches.

Figure 5:
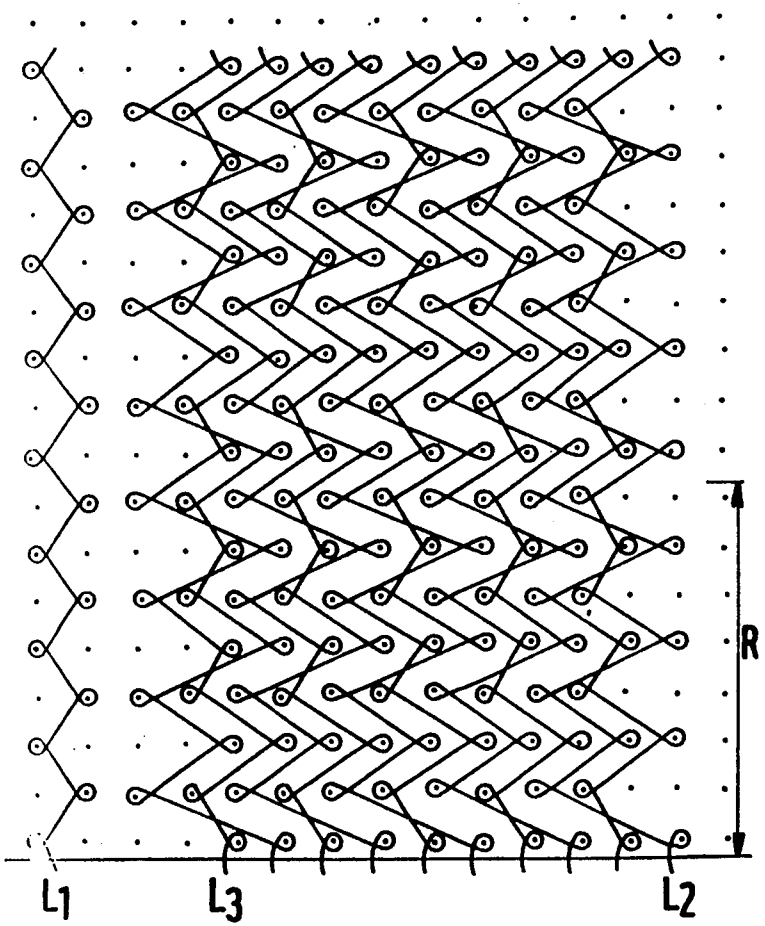
FIG. 5 is a first example of a lapping diagram for a ground thread system and two partial systems of the patterning system, showing the latter performing a ground displacement with both jacquard guide bars.
Figure 8:
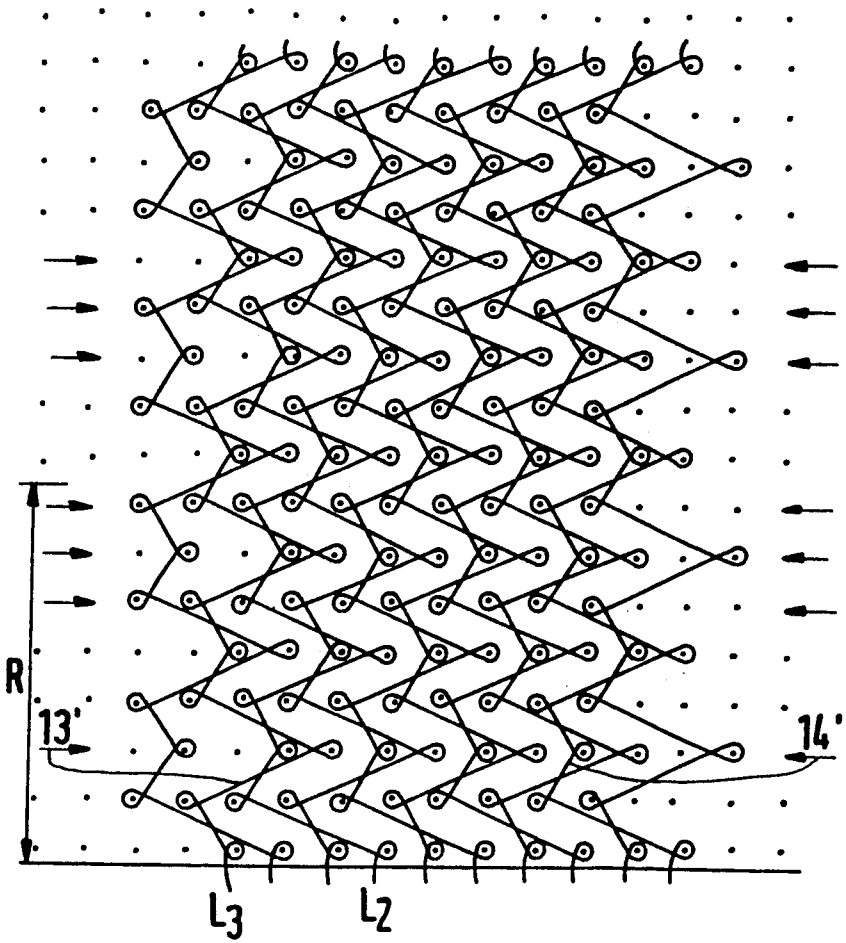
FIG. 8 is lapping diagram that is a variation from FIG. 6 and that follows a third deflection program.
Figure 7:
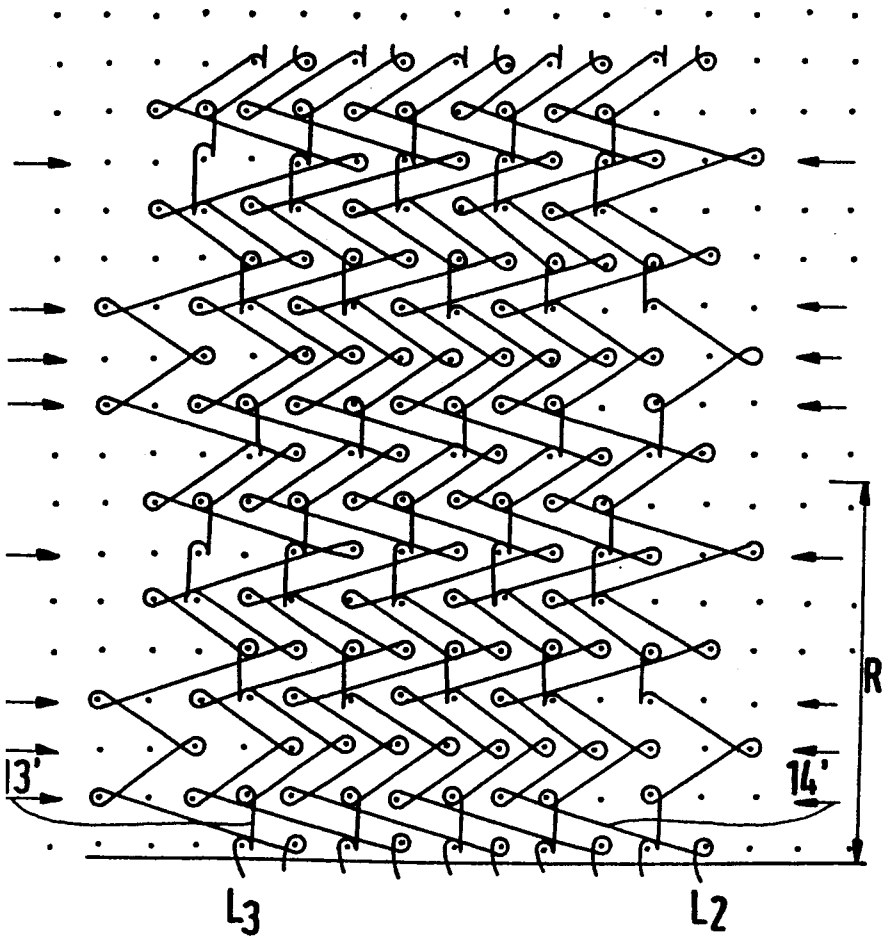
FIG. 7 is a lapping diagram that is a variation from FIG. 6 and that follows a second deflection program.

With respect to the patterned areas, area M1 corresponds to FIG. 5, area M2 corresponds to FIG. 7 and area M3 corresponds to FIG. 8.

The tricot groundware laid by guide bar L1 is only illustrated in FIG. 5 and is not repeated in the remaining Figures. FIG. 5, which corresponds to the pattern area M1 shows that eight work or knitting cycles comprise the repeat pattern R. The jacquard guide bar L3 carries out the ground displacement with the following sequence: tricot, cloth, cloth, tricot, cloth, satin, satin, cloth. Ground displacement here refers to the lapping motions provided by guides that have not been deflected or displaced by operation of a jacquard arrangement 17 or 18.

In a similar manner, jacquard guide bar L2 in the ground displacement lays: satin, cloth, cloth, satin, cloth, tricot, tricot, cloth.

Each pattern repeat for guide bars L2 and L3 has two tricot laps, four cloth laps, and two satin laps. The average underlap is thus equal to the cloth lap.

FIG. 6, which is directed to the basis area B, shows in the first, fifth, sixth and eighth work cycle of each pattern repeat R, that all of the guides operating in the basis area are deflected. Arrows 13' indicate deflection of a contiguous group of guides at guide bar L3, and arrows 14' deflection of guides at guide bar L2. This leads to the complete formation of the illustrated cloth lap.

In the embodiment of FIG. 7 which is directed to pattern area M2, the guide deflection as shown by arrows 13' and 14' (guides L3 and L2, respectively) occurs in the second, third, fourth and seventh work cycle of the pattern repeat R. Thus, guide bar L3 gives rise to the following lapping: pillar, cloth, cloth, pillar, cloth, velvet, velvet, cloth. For guide bar L2 the lapping is velvet, cloth, cloth, velvet, cloth, pillar, pillar. Thus both repeats for guide bars L2 and L3 contain two pillar laps, four cloth laps and two velvet laps. Again, the average underlap is equivalent to that for the cloth lap.

In accordance with FIG. 8 which is directed to the pattern area M3, the deflection of the appropriate guides as shown by arrows 13' and 14' (guide bars L3 and L2, respectively) occurs in the third, sixth, seventh and eighth work cycle. This deflection leads to jacquard guide bar L3, providing the following lapping: tricot, satin, satin, tricot, tricot, satin, satin, tricot. Jacquard guide bar L2 provides the following lapping: satin, tricot, tricot, satin, satin, tricot, tricot, satin. Again, the average underlap length is equivalent to that of a cloth lap.

As will be seen by a review of the lapping diagrams, when the ground displacement is tricot or a satin lap, it is very easy to change over not only to the cloth lap but also to pillar stitch or velvet lap. The additional utilization of cloth lap in the ground displacement makes possible a larger number of pattern changes. Furthermore, it simplifies the conversion from pillar to velvet and reverse.

It should further be noted that the laps so proceed that in the middle of the pattern area, all stitches of the groundware are lapped about with stitches of the pattern system. It is to be understood that with other ground displacements, other combinations or other sequences of laps are also possible.

Figure 10:
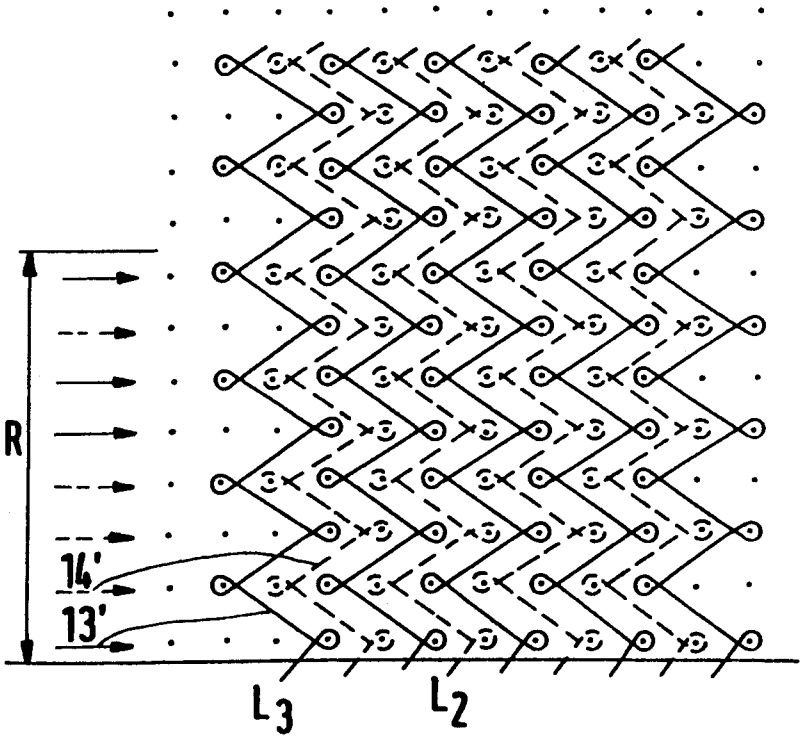
FIG. 10 is a lapping diagram derived from FIG. 9 showing both partial systems of the thread pattern system following a first deflection program, which provides a cloth lap.
Figure 9:
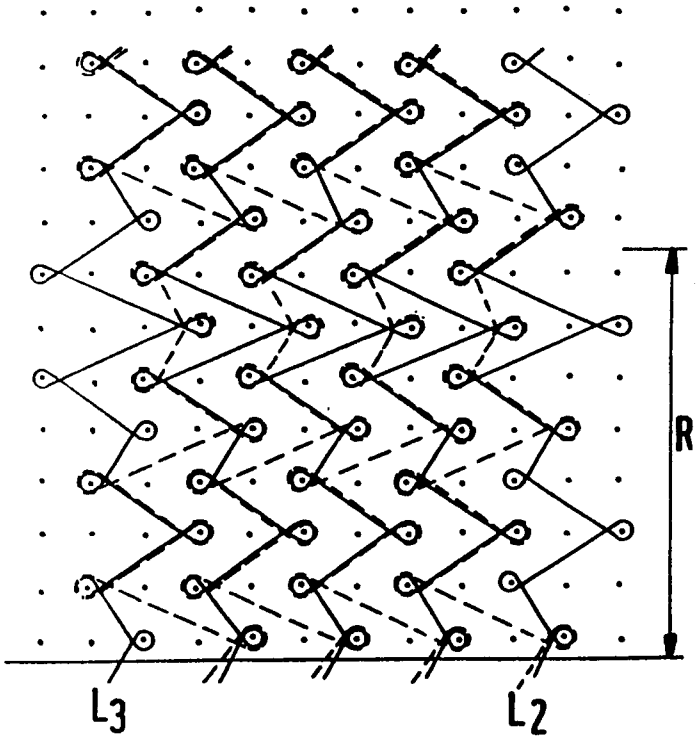
FIG. 9 is a second embodiment of the fabric, illustrated through a lapping diagram showing both partial systems of the pattern thread system performing a displacement with both jacquard guide bars.
Figure 11:
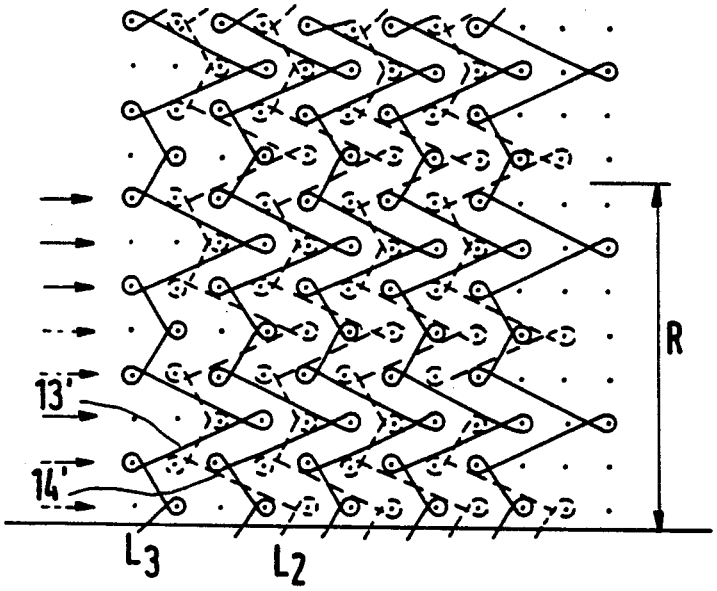
FIG. 11 is a lapping diagram derived from FIG. 10 and following a second deflection program.

A further embodiment is illustrated in FIGS. 9 through 11. Herein, the jacquard guides bars L2 and L3 are so arranged that their guides are deflected in the direction of arrows 13' and 14' in the same direction (arrows 14' are shown dotted). The guides in their non-deflected setting are arranged to overlap upon each other. Both of these laps start paired into the same needle gaps, with an unlapped needle remaining in between. However, threads 21 and 22 do not form common stitches with each stitch of the ground fabric. Such continuity, however, is unnecessary since the groundware is closed in itself.

The ground displacement for FIG. 9 provides the following lap for jacquard guide bar L2 (dotted laps): satin, cloth, cloth, satin, cloth, tricot, tricot, cloth. Complementary jacquard guide bar L2 (laps shown in full line) shows the sequence: tricot, cloth, cloth, tricot, cloth, satin, satin, cloth. This gives the first patterning area M1.

FIG. 10 shows an evenly patterned basis area containing the cloth pattern throughout. Therein, the guides of either one or the other jacquard bar are deflected. The guides of bar L2 are deflected at the dotted arrows 14', while the guides of bar L3 are deflected at the solid arrows 13'.

FIG. 11 shows a second patterning area (corresponding to FIG. 8) which is designated as pattern area M3. Also here through selected control of the guides of each jacquard guide bar, a repeated pattern may be obtained in each pattern repeat R in which the average length of the underlap for each repeat is substantially the same as the underlap length for the cloth lap. Here the guides of bar L2 are deflected at the dotted arrows 14', while the guides of bar L3 are deflected at the solid arrows 13'.

Figure 12:
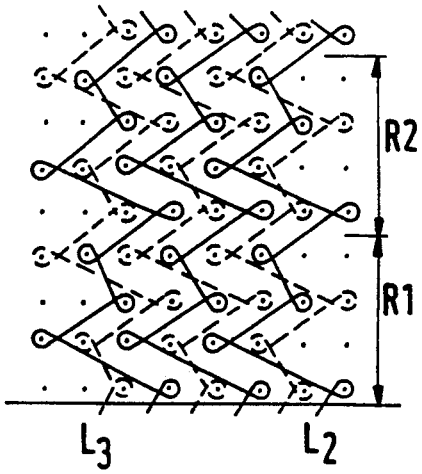
FIG. 12 is a third embodiment of the fabric, illustrated through a lapping diagram showing both partial systems of the thread pattern system performing a ground deflection with both jacquard bars.
Figure 13:
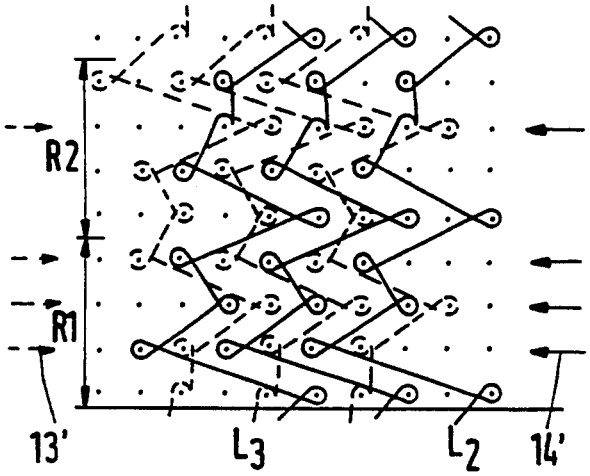
FIG. 13 is a lapping diagram derived from FIG. 12 showing a second deflection program.

In the third embodiment of FIGS. 12 and 13, the ground displacement of FIG. 12 shows two equal partial pattern repeats R1 and R2. In each partial pattern repeat, the jacquard guide bar L2 lays: satin, cloth, tricot, cloth (shown in solid lines). The guide bar L3 lays: tricot, cloth, satin, cloth (shown in dotted lines). Again, the ground pattern can be laid as tricot by guide bar L1. In this manner, the lapping of FIG. 12 produces the pattern area M1.

The basis area B is not illustrated. It is obtained in a manner analogous to FIG. 6 which increases the length of the tricot lap and shortens the satin lap. This means that in the first and last step of each partial pattern repeat R1 and R2, the guides of the jacquard guide bars L2 and L3 are deflected in opposite directions (left and right, respectively, in this view).

A pattern area M2 is illustrated in FIG. 13. Here it is shown how, through deflections of the jacquard guides that are different in the pattern repeats R1 and R2, an eight course repeat is obtained in which the jacquard guide bar L2 (solid lines) lays: velvet, cloth, tricot, satin, satin, tricot, pillar, cloth. The jacquard guide bar L3 (dotted lines) lays: pillar, cloth, satin, tricot, tricot, satin, velvet, cloth.

In addition to the deflection program for the basis area B and the pattern areas M1 and M2, there is also a third deflection program for the provision of pattern area M3, which corresponds with FIG. 8. This means that two tricot laps and two satin laps alternate with each other. In order to obtain this, it is necessary that in each partial repeat R1 and R2 of FIG. 12, in the third and fourth line, the guides of the jacquard bars L1 and L2 are deflected in opposite directions (guides L2 to the left and guides L3 to the right).

We claim

1. Warp knitted fabric having both in the weft as well as the warp direction differently structured areas comprising:

at least one ground thread system for the formation of a fabric ground; and a pattern thread system including at least a pair of threads which are stitched to change successively in the warp direction between (a) a plurality of basis regions in 2 & 1 stitch, and (b) a plurality of pattern areas in a sequence of different laps, selected from the group consisting of pillar, tricot, 2 & 1, satin, and velvet stitches, said basis regions and said pattern areas and their laps changing periodically according to a predetermined schedule to make average periodic thread consumption due to successive underlap motions substantially equal to thread consumption due to underlap motion in a 2 & 1 lap.

2. Warp knitted fabric in accordance with claim 1, wherein said pattern areas comprise at least two different types of stitches having different lapping.

3. Warp knitted fabric in accordance with claim 2, wherein the tricot and satin stitches within at least one of said pattern areas are equal in number within said predetermined schedule.

4. Warp knitted fabric in accordance with claim 2, wherein the pillar and velvet stitches within at least one of said pattern areas are equal in number within said predetermined schedule.

5. Warp knitted fabric in accordance with claim 2, wherein 2 & 1 stitches exist within at least one of said pattern areas.

6. Warp knitted fabric in accordance with claim 3, wherein 2 & 1 stitches exist within at least one of said pattern areas.

7. Warp knitted fabric in accordance with claim 2, wherein the pattern thread system comprises two partial systems whose threads are laid differently within each of the patterning areas to form common stitches with all of the stitches of the fabric ground.

8. Warp knitted fabric in accordance with claim 7, wherein the ground thread system is made of tricot stitches.

9. Process for preparing warp knitted fabric having a ground thread system and a pattern thread system, comprising the steps of:

providing said ground thread system to establish a ground fabric; and providing said pattern thread system by:

(a) laying, in part, 2 & 1 lapping; and (b) laying, in part, a sequence of varying laps selected from the group consisting of pillar, tricot, 2 & 1, satin, and velvet, and ordered with a predetermined schedule to make average periodic thread consumption due to successive underlap motions substantially equal to thread consumption due to underlap motion in a 2 & 1 lap.

10. Process in accordance with claim 9 employing two partial jacquard control systems, the step of providing said pattern thread system comprises:

executing with said two partial systems within said predetermined schedule an equal number of tricot and satin laps, either alone or in combination with 2 & 1 laps.

11. Process in accordance with claim 10, wherein the step of laying said pattern thread system comprises:

successively operating the jacquard control systems to lay within said predetermined schedule (a) entirely 2 & 1 laps, and (b) a sequence of varying laps, different from said ground displacement.

12. Process according to claim 11, wherein the step of operating the jacquard controls comprises:

laying within said predetermined schedule another sequence having an equal number of pillar or velvet laps, either alone or in combination with 2 & 1 laps.

13. Process of claim 12, wherein the step of providing the ground fabric is performed by laying tricot stitches.

14. Process of claim 9, wherein the step of providing the ground fabric is performed by laying tricot stitches.

* * * * *